US005779515A

United States Patent [19]

Chung

[11] Patent Number: 5,779,515

[45] Date of Patent: Jul. 14, 1998

[54] CONSTRUCTION TOY SUPPORT BASE

[75] Inventor: Henry Hung Lai Chung, Downsview, Canada

[73] Assignee: Ritvik Holdings, Inc., Quebec, Canada

[21] Appl. No.: 717,913

[22] Filed: Sep. 23, 1996

Related U.S. Application Data

[63] Continuation of Ser. No. 494,029, Jun. 26, 1995, abandoned.

[51] Int. Cl.[6] ..... A63H 33/08

[52] U.S. Cl. ..... 446/90; 446/91; 446/102; 446/118

[58] Field of Search ..... 446/236, 118, 446/90, 102–104, 246, 91, 484

[56] References Cited

U.S. PATENT DOCUMENTS

| | | | |
|---|---|---|---|
| 3,696,548 | 10/1972 | Teller | 446/91 |
| 4,109,398 | 8/1978 | Hida . | |
| 4,813,903 | 3/1989 | Furukawa et al. | 446/90 |
| 4,864,879 | 9/1989 | Hou | 446/118 X |
| 4,936,185 | 6/1990 | Yamaguchi et al. | 446/91 X |
| 4,983,890 | 1/1991 | Satoh et al. | 446/175 X |
| 5,360,364 | 11/1994 | Poulsen et al. | 446/102 |
| 5,411,428 | 5/1995 | Orii et al. | 446/90 |

FOREIGN PATENT DOCUMENTS

| | | |
|---|---|---|
| 0 124 237 | 11/1984 | European Pat. Off. . |
| 0 590 432 | 4/1994 | European Pat. Off. . |
| 1 914 624 | 10/1970 | Germany . |

*Primary Examiner*—Mickey Yu
*Attorney, Agent, or Firm*—Michael D. Bednarek; Kilpatrick Stockton LLP

[57] ABSTRACT

A base for a modular multi-part construction toy is disclosed which has a surface which permits the assembly of a number of toy modules thereon to form an erected toy. The base further includes a number of mechanically movable elements which are used in association with various drive shaft pieces to rotate or otherwise move part or all of the erected toy. The drive shaft pieces are engaged by the movable elements which in turn are driven in movement by gearing mechanically coupled to a motor which is housed internally within the base. The base further includes a number of electrical receptacles for supplying electric power to electric light emitting toy modules, and an audio output mechanism for producing sounds associated with the erected toy. The surface of the base may further be provided with a desired contour or profile and have indicia which simulates a particular geographic location, vehicle, vessel, or other structure.

22 Claims, 7 Drawing Sheets

CONSTRUCTION TOY SUPPORT BASE

This application is a continuation application of Ser. No. 08/494,029 filed Jun. 26, 1995, abandoned.

SCOPE OF THE INVENTION

The present invention relates to a base for a multi-part construction type toy which has as its basic component units, interconnectable modules or elements which can be stacked or otherwise coupled together to construct various toys. The base is provided with a surface which permits the assembly of the toy modules thereon, and in which a number of mechanically movable sockets are provided which may be used to rotate or move part or all of the erected toy.

BACKGROUND OF THE INVENTION

Construction type toys are well known. Typically such toys incorporate two or more basic modules or units of different shapes, sizes and lengths which are manufactured so that the modules may be releasably interconnected, whereby a number of modules can be assembled together to form a number of different toys. The modules usually are coupled together by one of three methods. In one method the modules are provided with at least one projection and one recess which have a complementary size and shape, such that when the projection of one module is interfitted into the recess of another module, the modules are releasably coupled together in a snap or friction fit. In another method one module may be provided with one end which acts as a male plug having a size configured for sliding engagement in a slot formed in another module. Alternatively, the modules may be coupled by small bolts and threaded nuts or the like.

Several multi-part construction toys, such as those sold under the trade marks LEGO, K'NEX and MECCANO, are also provided with peripheral components such as wheels and wheel modules, figurines, window units and the like. The peripheral components are formed to interact with and couple with the basic modules, and provide the toy user with greater flexibility in the types of toys which may be constructed.

Conventional construction type toys have been somewhat constrained by the fact that the assembled toy is not powered in movement, nor is it possible for the player to partly or wholly control the toy which has been assembled. Given the present complexity of complete factory-assembled mechanized toys available, which not only move, but may include flashing lights and/or realistic sounds, there is the risk that a child may become prematurely bored with existing construction toys in favour of the more stimulating factory-assembled mechanized toys.

In one attempt to provide a more stimulating construction type toy, U.S. Pat. No. 4,109,398 to Hida, issued Aug. 29, 1978, discloses a construction toy in which one or more separate gear assemblies and a motor are provided internally within individual specialized interconnecting capsules. With the Hida toy, the capsule containing the motor is linked together with a capsule which contains gearing to form a movable vehicle or the like. The Hida toy suffers the disadvantage in that it requires complex and costly design and manufacturing to fit both the gearing and motor into the capsules. Further, the capsule construction of Hida limits the configuration and type of toys which may be constructed as compared to other conventional construction type toys, because the capsules must be used to form one part of the constructed toy itself. As well, with the motor of Hida provided internally within a specialized capsule, capsules of a comparatively large size are required to house the motor and gears.

SUMMARY OF THE INVENTION

Accordingly, it is an object of the present invention to provide a construction toy base upon which various toy modules may be detachably mounted, and which is provided with a number of mechanical elements which may be used to actuate one or more of the toy modules into movement.

A further object is to provide an inexpensive and easily manufactured construction toy support base which is adapted to actuate movement in all or part of a construction toy which has been erected thereon, and which can be readily modified in manufacture for use with a number of existing conventional construction toys, such as LEGO building blocks, K'NEX toy systems, MECCANO construction toys, and the like.

Another object of the invention is to provide a base unit for a construction toy which simulates a topographical profile, building, vessel, vehicle or the like upon which a plurality of toy modules may be erected.

Another object of the invention is to provide in a construction toy electrically operable toy modules which emit light and a base unit configured to electrically couple with and supply electric current to the electrically operable toy modules.

Another object of the invention is to provide a construction toy which is adaptable to create sound effects or produce realistic sounds which are related to a toy which has been constructed from a number of toy modules.

A further object of the present invention is to provide a toy which includes a number of interconnectable toy modules, a base unit having a number of movable sockets and one or more rigid or flexible drive shaft elements sized for insertion in the sockets and which when inserted therein, engage and rotate one or more of the toy modules located in substantially any position in the constructed toy.

In one embodiment, the present invention resides in a construction toy which includes a number of interconnectable toy modules, a supporting base having a number of movable elements, such as rotatable sockets, and at least one drive shaft which when engaged by a movable element engages and moves a toy module.

With the present invention, the toy modules may be provided with different overall shapes and sizes, and may, for example, be any one version of the major types of construction toys, namely LEGO, MECCANO, or K'NEX. By coupling various toy modules together, almost any type of toy may be constructed. At least one toy module includes one or more projections and one or more recesses, and is adapted for coupling to other toy modules. More preferably each toy module has a number of projections and recesses. The projections and recesses of the modules have a complementary size and shape which permits the insertion of the projection of one module into the recess of another, thereby releasably coupling the two modules together in a friction or snap fit.

The base unit is provided with one or more surfaces having formed therein either recesses or projections which are complementary to those of the toy modules. The recesses and projections on the base surfaces engage the corresponding projections or recesses of at least some of the modules to releasably couple the assembled toy thereto. Preferably a number of rotatable sockets or other movable element are provided in openings formed through the surface of the base. The sockets are connected to a motor by a linkage assembly consisting of gears and one or more linkage arms which are internally housed within the base. The gearing may be configured so that the activation of the motor moves different sockets through different degrees and/or speeds and/or directions of either rotational or vertical movement. For example, the gearing may permit the rotation of various sockets at different speeds through 360° of rotation, while rotating other sockets reciprocally through 90°, 60° or other selected degrees of rotation.

The drive shaft element which is used to engage the toy modules may be rigid or flexible and of almost any desired length or shape. The shaft element preferably has an end portion with a size and shape selected for insertion into a socket, such that the rotation of the socket also moves the drive shaft element through rotational movement.

More preferably, the sockets are movably connected to the motor by a linkage assembly which may be disengaged by a clutch. The clutch is constructed to disengage the motor from the sockets or gears if too large a resistive force is applied to any one socket or drive shaft.

The base unit may also be provided with one or more electrical outlets or receptacles for electrically connecting external LED's or other light sources to an electrical power supply. A speaker and removable sound card may also be housed within the base unit to simulate the sounds typically produced by the constructed toy.

The base unit may be formed having a single flat planar upper surface, or may also have a number of horizontally spaced mounting surfaces which may, for example, simulate changes in topography or sea level, as well as vessels, vehicles, building structures, and the like. If desired, each or different mounting surfaces at different levels and/or inclinations may have one or more sockets or other mechanical or electrical receptacles or elements provided therein.

Accordingly in one aspect the present invention resides in a construction toy comprising, a plurality of releasably connectable toy modules, drive shaft means for actuating at least one of said toy modules into movement, and supporting base means for supporting said toy modules thereon, said drive shaft means including a first end portion having a substantially polygonal cross-sectional shape, and a second end portion for engaging at least one of said toy modules, said base means including, upper mounting surface means including coupling means to releasably couple a plurality of said modules to said base means, a plurality of openings formed through said mounting surface means sized to permit insertion of the first end portion of said drive shaft therein, a plurality of rotatable socket means, each said socket means axially aligned with a corresponding one of said openings, and having a complementary size and shape to said drive shaft means first end portion to permit its insertion therein, drive means for activating said socket means in rotational movement whereby the rotation of said means activates any drive shaft means inserted therein into rotational movement to rotate said toy modules engaged by said second end portion, said drive means including a motor, power supply means for supplying power to said motor and linkage means for mechanically coupling said motor to said socket means, and clutch means for decoupling said motor from said socket means on the application of a critical load on one of said socket means.

In another aspect the present invention resides in a supporting base for use with a construction toy having a plurality of releasably connectable toy modules and drive shaft means having a first end portion for engaging said base and a second end portion for engaging at least one of said toy modules to activate at least one toy module into movement, the supporting base for mounting the toy modules thereon and including, mounting surface means including projection means to engage and releasably couple a plurality of said modules thereon, a plurality of openings through said mounting surface means, each of said opening sized to permit insertion of the first portion of said drive shaft means therein, a plurality of rotatable socket means, each of said socket means axially aligned with a corresponding one of said openings, and having a complementary size and shape to said first end portion of said drive shaft means for insertion of said first end portion therein, drive means for activating said socket means in rotational movement whereby the rotation of the socket means activates the drive shaft means inserted therein into rotational movement to rotate said toy module engaged by said second end portion, said drive means including an electric motor, and linkage means for mechanically connecting said motor to said sleeve means, and clutch means for disconnecting said motor from said socket means on the application of a critical load on one of said socket means.

In a further aspect, the present invention resides in a construction toy comprising a plurality of toy modules supporting base means for supporting said toy modules thereon, and drive shaft means having a first end portion for engaging said base means and a second end portion for engaging one of said toy modules, each of said toy modules including a plurality of substantially identical recesses and a plurality of module projections, each said module projection sized for complementary insertion into a corresponding one of said recesses, whereby the insertion of one or more of said module projections of a first toy module into corresponding recesses of a second toy module releasably couples the first and second toy modules together, said supporting base means including mounting surface means having a plurality of base projections having substantially the same configuration as said module projections, whereby the insertion of one or more of said base projections into the recesses of said toy module releasably couple the toy module to the base means, a plurality of circular openings formed through said mounting surface sized to permit insertion of the first end portion of the drive shaft means therein, a plurality of socket means for receiving said first end portion of the drive shaft means therein, each of said socket means rotatably disposed in one of said openings, drive means for activating said socket means into rotational movement wherein the rotation of said socket means activates a corresponding drive shaft mean inserted therein into rotational movement to rotate said toy module engaged by said second end portion, said drive means including an electric motor, power supply means for supplying power to said motor, and linkage means for mechanically coupling said motor to said socket means, said linkage means including gearing means which on activation of said motor reciprocally rotates a first one of said socket means and rotates a second one of said socket means through 360° movement.

DESCRIPTION OF THE PREFERRED EMBODIMENTS

Figure 1:
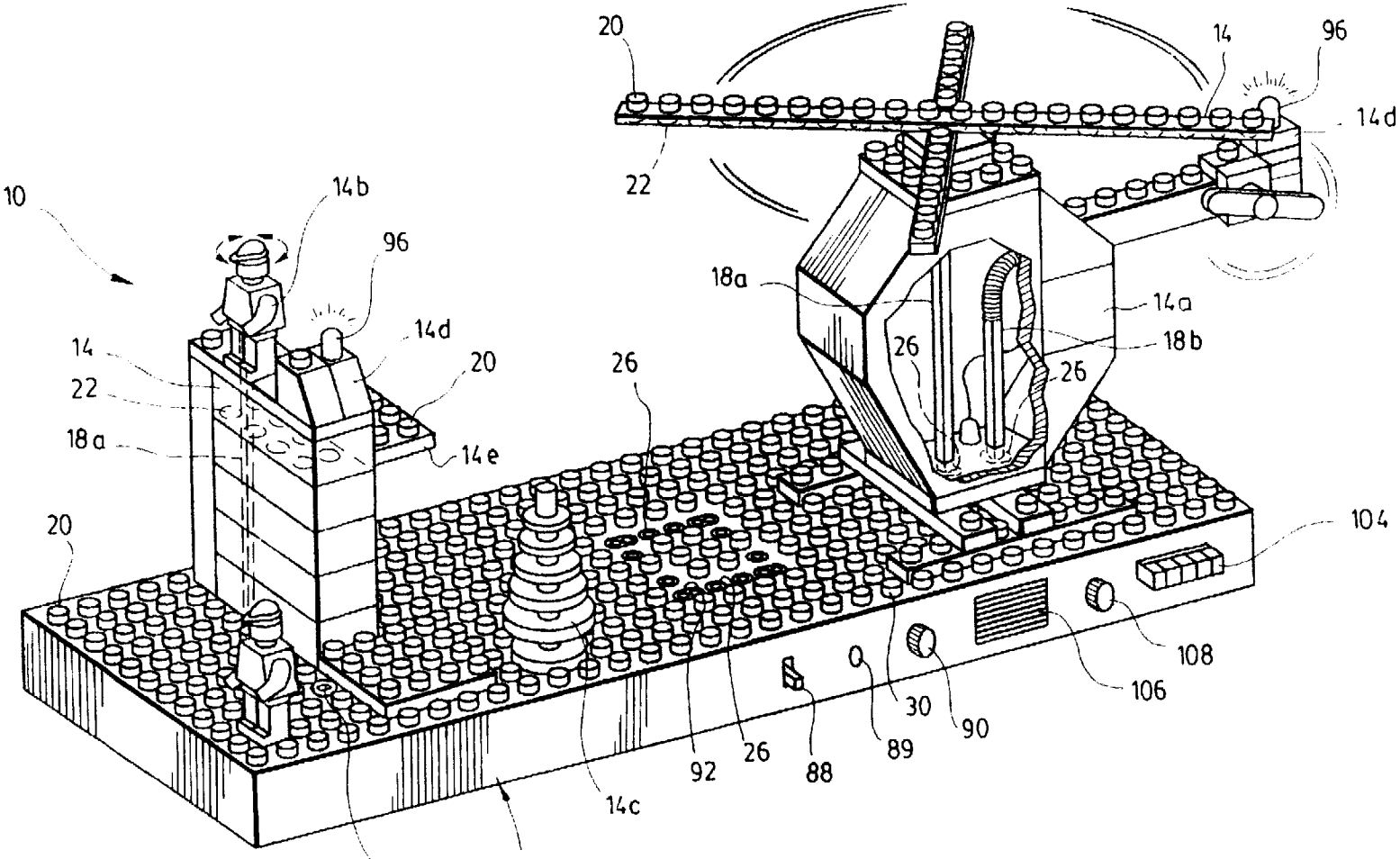
FIG. 1 is a perspective partially cut-away view showing an assembled construction toy in accordance with a preferred embodiment of the invention.

Reference is made to FIG. 1 which shows a construction toy 10 in accordance with a first embodiment of the invention. The toy 10 includes a base unit 12, a number of interconnectable plastic toy modules 14, and one or more elongated plastic drive shaft elements 18*a* and 18*b* which, as will be described hereafter, are used to drive one or more of the toy modules 14 in movement.

FIG. 1 shows best the toy modules 14 as being of the type found in LEGO™ construction toys. The modules 14 are of a conventional known type and include block-like modules 14*a* of differing widths and/or lengths, as well as a smaller number of specialty modules 14*b*, 14*c*, 14*d*, 14*e* which simulate people, trees, lamps and other shapes and structures. Each of the modules 14 is characterized by a surface having a number of uniformly spaced cylindrical projections 20 and a surface having a number of correspondingly shaped and sized cylindrical recesses 22. As is known, the projections 20 and recesses 22 of the block-like modules 14*a* are aligned in opposing parallel surfaces to permit the modules 14*a* to be stacked together. The recesses 22 are positioned in an identical spaced arrangement to that of the projections 20, such that the projections 20 of one module 14 may be inserted into the recesses 22 of another, thereby releasably coupling the modules 14 together in a snap fit.

It is to be appreciated that while FIG. 1 shows the construction toy 10 assembled to form a toy helicopter and a toy castle, the arrangement of the projections 20 and recesses 22 permit the toy modules 14 to be stacked in an interconnected arrangement to form almost any fictional or realistic toy structure, vehicle, machine, person and/or animal, or the like.

The base unit 12 is provided as the support upon which the modules 14 are assembled in erecting a toy, and includes a number of movable cylindrical sockets 26 which, as will be described hereafter, are used to actuate all or part of the erected toy in movement.

The base unit 12 shown in FIG. 1 includes a generally planar mounting surface 28. To enable the modules 14 to be mounted on the base unit 12, the mounting surface 28 is provided with a number of upwardly extending cylindrical projections 30 having the identical size and substantially the same spacing as the module projections 20. In this manner, the toy modules 14 may be releasably coupled to the mounting surface 28 by the insertion of one or more of the projections 30 into corresponding module recesses 22.

Figure 2:
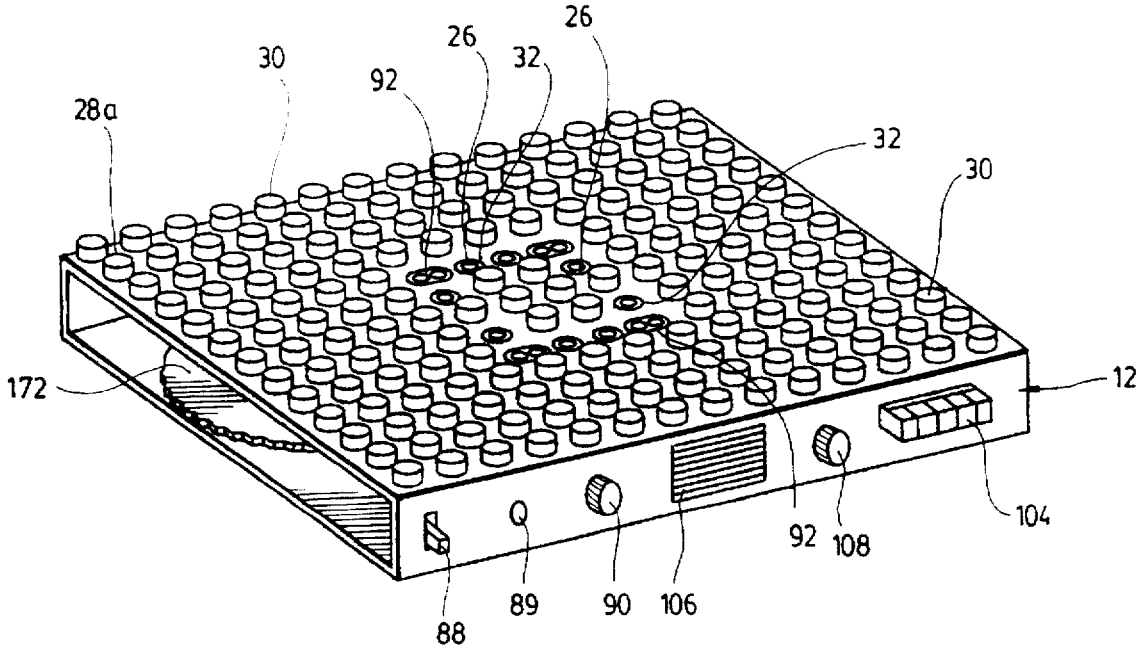
FIG. 2 shows a perspective view of the right hand portion of the base unit of FIG. 1, prior to the erection of the toy modules thereon.

FIG. 2 shows best a partially cut-away portion of the base unit 12 which includes the right hand portion of the mounting surface 28*a* prior to the erection of toy modules 14 thereon. Mounting surface 28*a* has eight rotatable sockets 26 provided therein at various spaced locations. The sockets 26 are shown as located so as to occupy the position which would otherwise be occupied by a projection 30, but could equally be provided in other spaced arrangements. Preferably each socket 26 is rotatably provided centered within an associated circular aperture 32 which extends through the mounting surface 28*a*.The sockets 26 are flush with or slightly recessed into the mounting surface 28 so as not to interfere with the mounting of the toy modules 14 on the base unit 12. As seen best in FIGS. 3 and 4, the sockets 26 open upwardly to define an axially extending square recess having a size selected to receive therein a lower end of a drive shaft element 18*a*,18*b*, so that movement of the socket 26 rotates a corresponding drive shaft element 18 which is inserted therein in movement.

Figure 3:
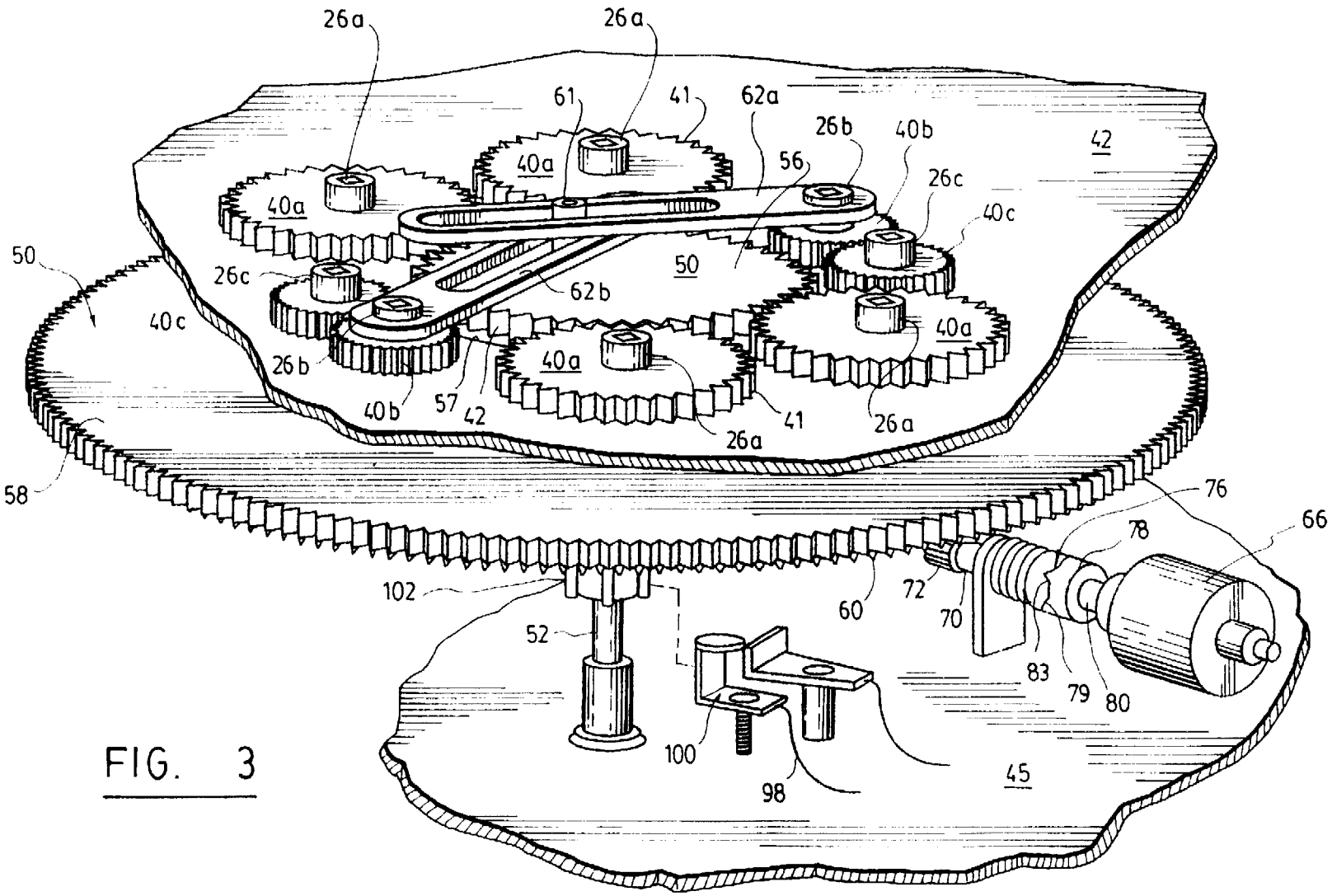
FIG. 3 shows a partial perspective view of the linkage assembly and gearing for use with the base unit portion shown in FIG. 2.
Figure 4:
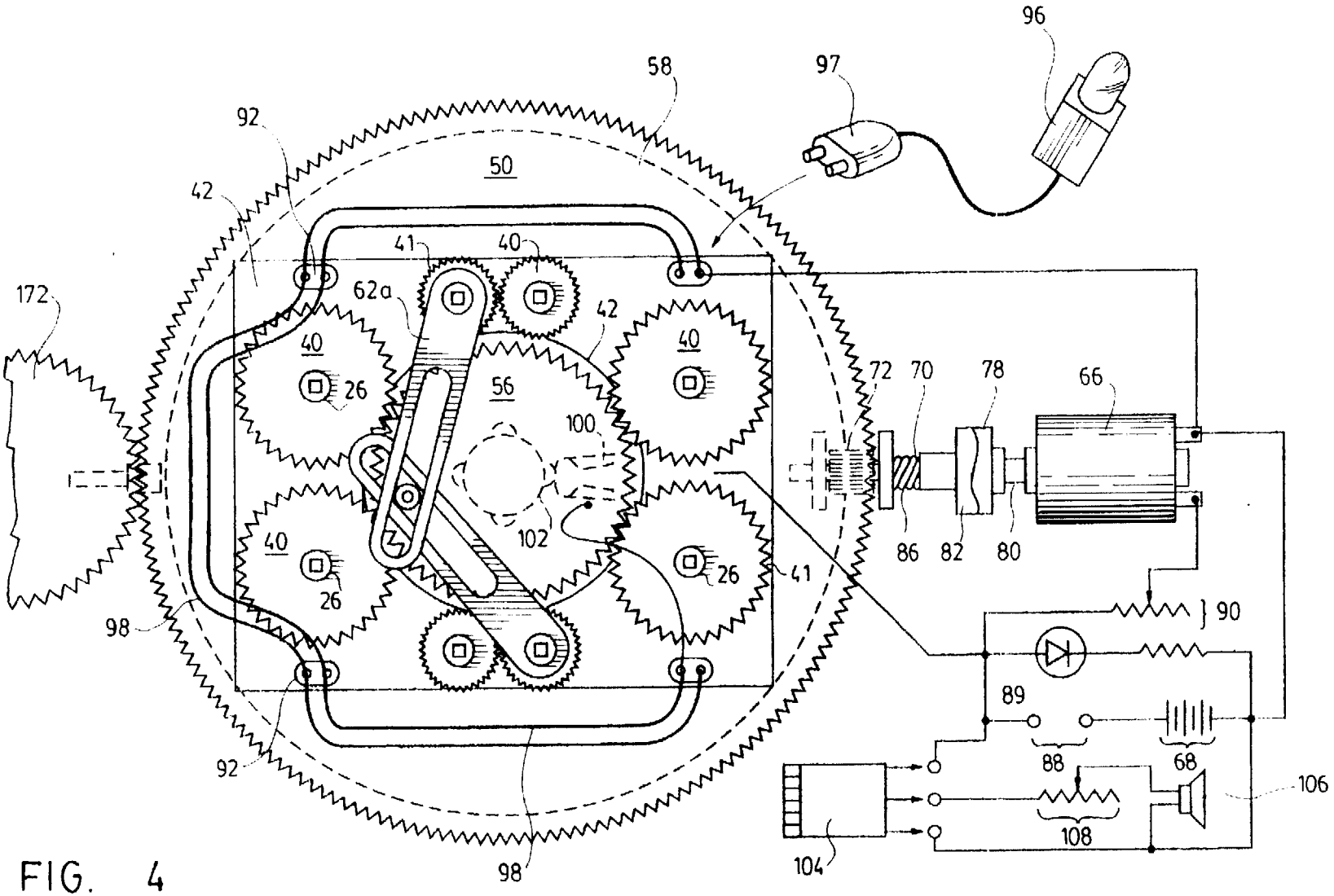
FIG. 4 shows a schematic view of the linkage assembly and gearing shown in FIG. 3.

FIGS. 3 and 4 show best the linkage assembly which is used to rotatably couple the sockets 26 to an electric motor 66. Each of the sockets 26 extend upwardly from the centre of an associated spur gear 40 which is rotatably housed with the base unit 12. The spur gears 40 are formed as flattened circular disks having toothed peripheral edges 41, and are positioned within the base unit 12 sandwiched between the underside of the mounting surface 28*a* and a horizontally extending divider panel 42 which is spaced above the bottom 45 of the base unit 12. The spur gears 40 are provided in a substantially co-planar orientation and are rotatably coupled to the divider panel 42 at locations spaced radially about a circular opening 46 formed through the panel 42.

A drive gear 50 is rotatably provided within the base unit 12 for driving the spur gears 40 in rotation. The drive gear 50 is rotatable on a central shaft 52 which is rotatably secured to the bottom 45 and aligned with the centre of the opening 46. The gear 50 includes an upper circular portion 56 which projects upwardly through the opening 46 and a lower enlarged circular portion 58 which extends radially outward between the divider panel 42 and bottom 45 of the base unit 12. The upper portion 56 of the drive gear 50 includes a toothed peripheral edge 57 for meshing engagement with the peripheral edge 41 of one or more of the spur gears 40. The lower portion 58 of the gear 50 includes a toothed radially extending lower rack 60 formed in the underside of the gear 50.

In the embodiment shown, four of the sockets 26*a* in the mounting surface 28*a* rotate through 360° of movement, two of the sockets 26*b* reciprocally rotate through approximately 60° of movement; and the remaining two sockets 26*c* rotate reciprocally through approximately 60° movement in an opposite direction to the direction of the sockets 26*b*.

The rotation of sockets 26*a* occurs by the direct engagement of the peripheral edge 57 of the upper portion 56 of the drive gear with the peripheral edge 41 of each of the associated spur gears 40*a*. As the drive gear 50 rotates, the engagement of the toothed edges 57,41 rotates the spur gears 40*a* and sockets 26*a* in the opposite direction. Sockets 26*b* are driven in reciprocal movement by the sliding of the engagement of a camming roller and pin 61 which projects upwardly from a peripheral upper surface of the portion 56, within slots formed in rocker arms 62*a*, 62*b* which are attached to each of the respective spur gears 40*b*. To minimize manufacturing costs, it is preferable that sockets 26*c* be driven in rotation by the engagement of the toothed peripheral edges 41 of the spur gears 40*b* with the peripheral edge 41 of a corresponding spur gear 40*c*. It is to be appreciated however that the speed at which the sockets 26 rotate and the directions and degrees of rotational movement may be easily varied by adjusting the arrangement of the spur gears 40.

As seen best in FIGS. 3 and 4, the drive gear 50 is driven in rotational movement by the electric motor 66 which is powered by a battery 68, and a linkage arm 70. The linkage arm 70 has provided at its end a pinion 72 which is configured to engage the lower rack 60.

A slip clutch 76 is provided to disengage the pinion 72 from the motor 66 in the event too large a resistive force is placed upon one of the sockets 26. The clutch 76 consists of a driving member 78 which is coupled to the motor drive shaft 80 and a driven member 82 provided on the linkage arm 70. The driving member 78 and driven member 82 are provided with complementary angled faces 79,83. The driven member 82 is slidable along the linkage arm 70 between a first position, wherein the angled faces 79 of the driving member 78 rotatably engage the angled faces 83 of the driven member 82; and a second position, where the driven member 82 is moved away from the driving member 78 and the angled faces 79 rotate relative to the faces 83.

The driven member 82 is coupled to the linkage arm 70 such that the rotation of the driven member 82 rotates the linkage arm 70 and pinion 72, while permitting sliding movement of the driven member 82 axially along the linkage arm 70 between the first and second position. The linkage arm 70 may therefore have a square cross-sectional profile, as is shown in FIG. 4.

A spring 86 is used to normally bias the driven member 82 to the first position in contact with the driving member 78. When a resistive load on the driven member 82 exceeds the critical load, the driving member 78 rotates relative to the driven member 82. On movement of the members 78,82 relative to each other, the sliding contact of the angular surfaces 79,83 urges the driven member 82 against the bias of the spring 86 away from the driving member 78 so that the driven member 82, linkage arm 70 and pinion 72 are no longer rotated by the motor 66. On the release of the resistive load forces, the spring 86 returns the driven member 82 into engaging contact with the driving member 78, whereby under either no load or normal load conditions the rotation of the motor drive shaft 80 and driving member 78 rotates driven member 82, linkage arm 70 and pinion 72, thereby rotating the drive gear 50.

The clutch 76 advantageously minimizes the risk of damage to the base unit 12 of the toy 10. If excessive resistant forces are applied to the drive gear 50, as for example on a child grasping a drive shaft element 18 with sufficient force as to prevent its rotation, as well as the associated socket 26 and the spur gear 40, the driving member 78 will continue to rotate relative to the driven member 82 and no excessive forces will be placed upon the motor 66. As the gears 40,50 are no longer rotated, the risk of damage to gearing of the base unit 12 is also eliminated.

The foregoing construction is thereby advantageous in that a small child may, when erecting a construction toy, impede the movement of one or more rotating sockets 26 without adversely harming the gears 40, drive gear 50, linkage arm 70 or the motor 66.

As schematically illustrated in FIG. 4, electricity flow from the battery 68 is controlled by an on/off switch 88, and current flow is indicated by a "power-on" light 89 provided on the side of the base unit 12. A rheostatic speed control 90 is preferably also provided, permitting the speed at which the motor 66 and sockets 26 rotate to be varied, maximizing the adaptability of the toy 10.

FIGS. 2 and 4 show best the base unit 12 as further including a number of electrical receptacles 92 which are electrically connected to battery 68 and controlled by switch 88. FIG. 4 illustrates the receptacles 92 as part of an electric circuit 98. Although not shown, it is to be appreciated that the circuit 98 extends as a loop under the entire mounting surface 28 to connect with the remaining receptacles 92. Like the sockets 26, the electrical receptacles 92 are flush with or recessed into the mounting surface 28 so as not to interfere with the mounting of the toy modules 14 on the base unit 12. The receptacles 92 are for use with light units 96 which include male connectors 97 adapted for removable insertion into a corresponding receptacle 92 and which may, for example, be provided as part of a specialty module 14*d*.

FIGS. 3 and 4 show best electric circuit 98 as including a spring contact switch 100 for providing intermittent current flow to the receptacles 92. A number of radially spaced camming projections 102 are provided about the rotatable shaft 52 which extends below the drive gear 50. As the gear 50 rotates, the camming projections 102 bias the spring contact switch 100 to a closed position which permits current flow to the receptacles 92. As each projection 102 rotates past the contact switch 100, the switch 100 resiliently returns to an unbiased, open position which interrupts current flow. As such, on rotation of the main drive gear 50, current is intermittently provided to the electrical receptacles 92 with the result that connected light units 96 flash on and off.

FIG. 4 illustrates the light unit 96 having a bulb, electrical cable, and plug, however, it is to be appreciated that the light unit 96 could have any desired shape, size and structure and could also be integrally formed as part of clear plastic module provided with male connectors for insertion into a receptacle.

The base unit 12 is preferably also provided with removable sound card 104, speaker 106 and volume control 108 which provide an audio signal indicative of a particular piece of equipment, vehicle or other toy which is to be erected. The sound card 104 may be supplied as part of a toy kit as to provide the sound effect which corresponds to the toy package.

Figure 5:
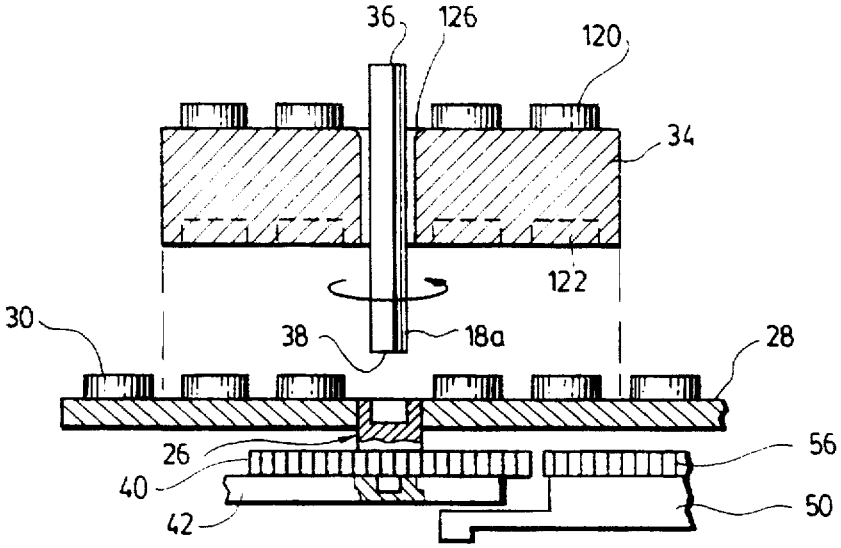
FIG. 5 shows an exploded partial cross-sectional view of a first rigid drive shaft element and a customized toy module for use with the construction toy of FIG. 1.

FIG. 1 shows two drive shaft elements 18*a*,18*b*.In the simplest construction, seen best in FIG. 5, the drive shaft element 18*a* is formed as an elongated plastic member having a rectangular construction with the top end 36 having a square cross-section sized to fit into the cylindrical recess 22 of a conventional module 14 in a friction-fit. The bottom end 38 of the element 18*b* has a square cross-section adapted for insertion into an associated one of the sockets 26. The top and bottom ends 36,38 are sized to snugly fit in the respective recess 22 and socket 26, such that the rotation of the socket 26 rotates the element 18*a* together with the toy module 14 which is coupled thereto. It is to be appreciated that both the bottom end 36 and socket 26 may also be provided with either a non-polygonal or other polygonal cross-sectional shape which minimizes the likelihood of the drive shaft element 18 slipping in the socket 26.

Figure 6A:
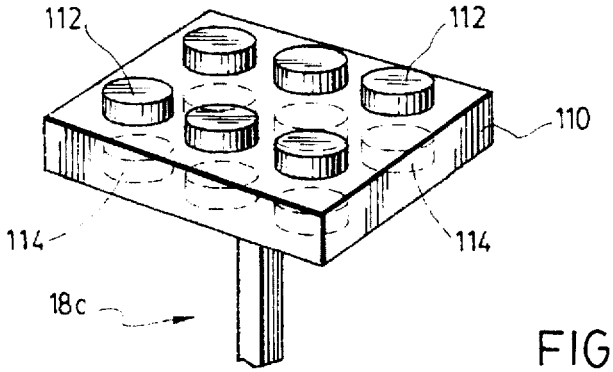
FIG. 6*a* shows a perspective view of a second modified drive shaft element for use with the present invention.
Figure 6B:
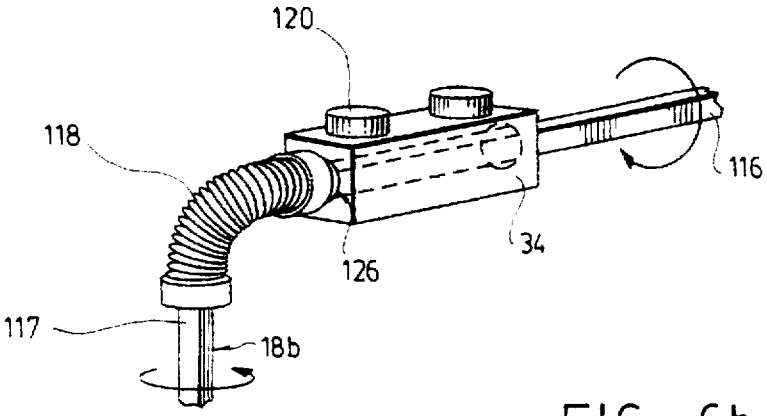
FIG. 6*b* shows a perspective view of another modified flexible drive shaft element for use with the toy of FIG. 1.

While a drive shaft element 18*a* having the simplified construction of FIG. 5 is economical to produce and may be provided in almost any length, it is to be appreciated that drive shaft elements having a more complex construction may also be used. FIGS. 6*a* and 6*b* show other such drive shaft elements 18*c*,18*b*. The bottom end 38 of the elements 18*b*,18*c* are essentially the same as that as shown in FIG. 5.

FIG. 6*b* shows the top end 36 of the drive shaft element 18*c* as being provided with an enlarged flattened portion 110. The flattened portion 110 includes a number of upwardly extending projections 112 as well as a number of spaced sockets 114 which are the same configuration as the toy module projections 20 and sockets 22. The projections 112 and sockets 114 thereby releasably coupling a toy module 14 to the top end of the shaft 18*c*.

FIG. 6*b* shows the drive shaft element 18*b* as being formed from two separate components 116,117 joined in the middle and which each have the same structure as element 18*a*. The top end 36 of component 116 has a square or other polygonal cross-section. A flexible spring 118 connects the top and bottom components 116,117, permitting the upper component 116 of the drive shaft element 18*b* to be angled relative to the lower component 117.

While the base unit 12 is primarily adapted for use with conventional toy modules 14, the applicant has appreciated that by providing a smaller number of customized modules 34,44,54,64 seen in FIGS. 7 to 11, which interconnect with the conventional modules 14, a construction toy 10 having even a greater degree of flexibility and utility may be achieved.

Figure 7:
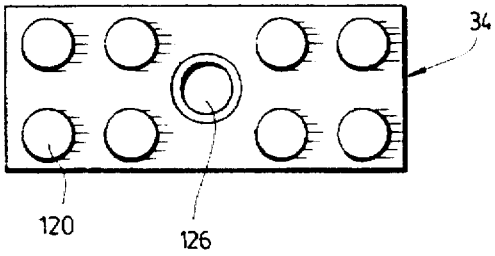
FIG. 7 shows a top view of the toy module of FIG. 5.

FIGS. 5, 6*b* and 7 show two variations of customized toy module 34 which may be used to conceal the drive shaft element 18 within an assembled toy. Each of the modules 34 are provided with a number of cylindrical projections 120 which have an identical shape and size and substantially the same spacing as projections 20. Corresponding shaped recesses 122 are also provided with the same size and spacing as the module recesses 22. The toy module 34 shown in FIG. 6*b* is provided with a horizontally extending cylindrical bore 126 which is used to conceal the horizontally oriented component 116 of drive shaft element 18*b*.

In the module 34 shown best in FIGS. 5 and 7, cylindrical bore 126 is provided in a vertical orientation formed through the centre of the module 34. It is to be appreciated that the bore 126 is sized having a radial diameter selected to permit unhindered rotation of a drive shaft element 18 which has been inserted therethrough. In the manner shown in FIG. 5 and 6*b*, the module 34 permits the erection of a construction toy 26 so that the drive shaft element 18 extends through the centre bore 126 formed in one or more stacked modules 34, and is thereby completely concealed.

Figure 8:
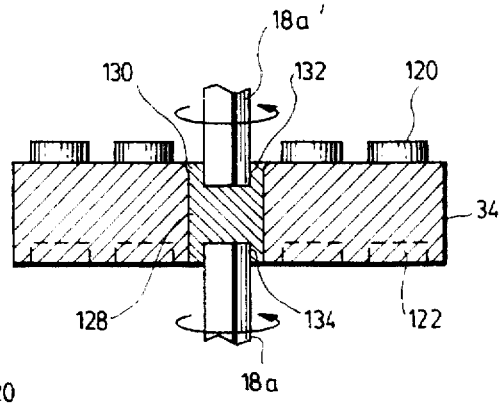
FIG. 8 shows a cross-sectional view of the toy module of FIG. 5 with a rotatable connecting sleeve inserted therein.

FIG. 8 shows a modified use of the module 34 for linking together two rectangular drive shaft elements 18*a*,18*a*'. A removable cylindrical coupling sleeve 128 is inserted into the bore 126. The coupling sleeve 128 is rotatably seated in the bore by means of an upper peripherally extending rim 130. Axially centered square upper and lower recesses 132,134 are provided in each end of the sleeve 128. The recesses 132,134 are sized to receive an end of each respective drive shaft element 18*a*',18*a* in a friction fit, joining the two drive shaft elements 18*a*',18*a* in rotational movement therewith.

Figure 9:
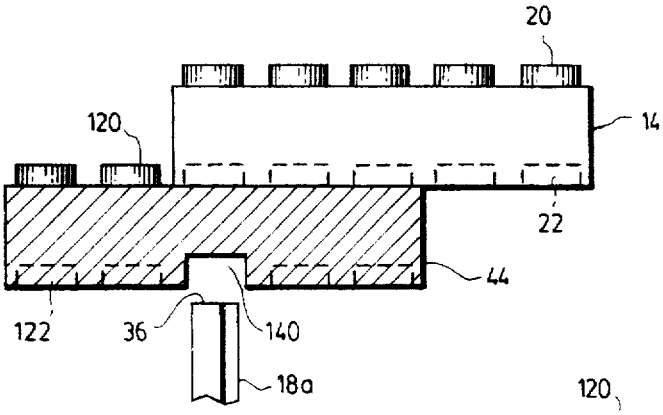
FIG. 9 shows a partially exploded cross-sectional view of a second customized toy module and conventional toy module for use with the drive shaft element of FIG. 5.

FIG. 9 shows another customized module 44 for use with a drive shaft element 18*a* having a square cross-section. Like the module 34, module 44 also includes a number of cylindrical projections 120 and recesses 122 which are identical in shape and size to projections 20 and recesses 22. The module 44 includes a square recess 140 which is formed in the centre of the lower surface of the module 44. The recess 140 is sized to receive therein in a complementary fit the square upper end 36 of a drive shaft element 18*a*. By the use of module 44, the drive shaft element 18 may be inserted into the recess 140, whereby the rotation of the socket 26 rotates the module 44, and any modules 14 which are connected thereto.

Figure 10:
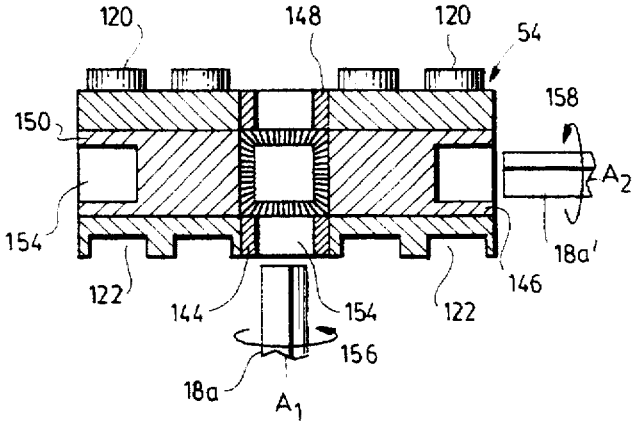
FIG. 10 shows a cross-sectional view of a third customized toy module for use with the construction toy of FIG. 1.

FIG. 10 shows yet another customized module 54. In addition to projections 120 and recesses 122, the module 54 is provided with four internally meshing bevel gears 144, 146,148,150. Each bevel gear 144,146,148,150 extends as a shaft from the centre of the module 54, opening into square shaped socket 154 which is sized to receive therein an end of rectangular drive shaft elements 18*a*,18*a*'. In the manner shown, when the drive shaft element 18*a* is inserted into the socket 154 of the bottom bevel gear 144 and the shaft element 18*a*' is rotated in the direction of arrow 156, the drive shaft element 18*a*' which has been inserted into the socket 154 of bevel gear 146 is rotated in the direction of arrow 158.

FIG. 10 illustrates a module 54 which incorporates four bevel gears 144,146,148,150 extending at right angles to each other. Other combinations and/or orientations of bevel gears are, however, also possible. Similarly, while each of the gears 144,146,148,150 are shown as extending outwardly to form a socket 154, one or more of the gears 144,146,148,150 could also extend beyond the module 54 and have an end adapted for rotatable insertion within a socket 26.

Figure 11:
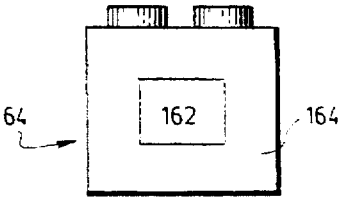
FIG. 11 shows a perspective end view of a fourth customized toy module for use with the construction toy of FIG. 1.

FIG. 11 shows an end view of a further customized module 64 for use with the present invention. The module 64 is identical to the module 14 with the exception that a square recess 162 is formed in one end surface 164 of the module 64. With the module 64, the square end of a drive shaft element 18a may be inserted into the square recess 162 to move the module 64 in rotational movement about an axis parallel to its upper and lower surfaces.

FIGS. 2 to 4 illustrate in detail one portion of the mounting surface 28*a* together with rotatable sockets 26, spur gears 40 and drive gear 50. Although not shown, it is to be appreciated that the sockets 26 which are provided in the remainder of the mounting surface 28 are driven in rotational movement by substantially identical spur gear/drive gear 40,50 assemblies. The drive gears 50 of the remaining mounting surface areas may be rotatably interconnected. Two or more sections or other mounting surfaces may be connected for rotation by a simple coupling gear mechanism, such as for example, by using a connecting spur gear 172 positioned between drive gears, as is shown in part in FIGS. 2 and 4. Alternately, the drive gear of each separate section of the mounting surface 28 may be driven independently by a separate motor and linkage assembly.

FIG. 1 shows a planar mounting surface under which various separate gear/drive gear 40,50 assemblies are provided. A single larger spur gear/drive gear 40,50 assembly could, however, also be provided under a mounting surface which is provided with a number of distinct mounting surface portions. The base unit 12 shown in FIG. 12 is provided with a number of generally horizontal vertically displaced mounting surfaces 28*a*,28*b*,28*c*, but is otherwise similar to the base unit 12 shown in FIG. 1, with like reference numerals identifying like components.

The mounting surfaces 28a–28c are illustrated as being generally horizontal, with immediately adjacent mounting surfaces 28 being vertically displaced relative to each other. FIG. 12 shows the base unit 12 as being formed so as to simulate sloping terrain and is preferably provided with colouring or other suitable indicia to simulate hills, water or other geographical features. The base unit 12 could, however, equally be formed to represent part of a building, vehicle or other geographical area and have one or more non-horizontal mounting surfaces 28 to which other suitable indicia are applied.

Figure 12:
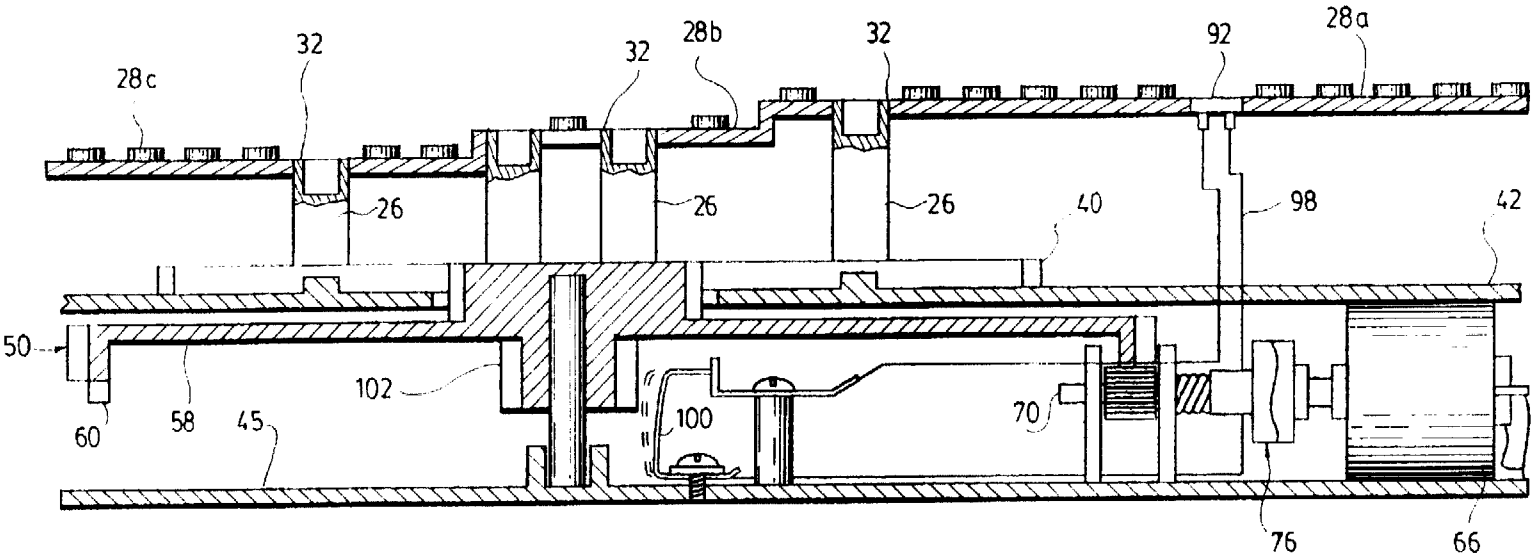
FIG. 12 shows a partial cross-sectional view of a base unit in accordance with a second embodiment of the invention.

The spur gear/drive gear 40,50 shown in FIG. 12 is substantially identical to that shown in FIGS. 3 and 4 with the exception that the sockets 26 extend upwardly at different heights from the associated spur gears 40, into a corresponding mounting surface area.

Although it is advantageous that the rotatable sockets 26 be recessed into the mounting surface 28 so as not to interfere with the assembly of the various toy modules 14 thereon, this is not essential. Further while the preferred embodiment illustrates a mounting surface 28 having horizontally rotatable sockets 26, if desired, additional sockets could be provided which are adapted for vertical movement relative to the mounting surface.

Figure 13B:
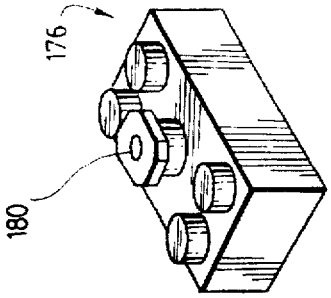
FIGS. 13*a* and 13*b* show schematic views of two adaptor toy modules for use with the present invention.
Figure 13A:
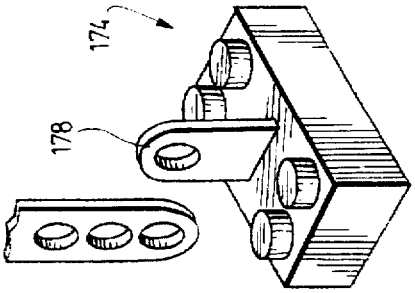

FIG. 1 illustrates the construction toy 10 as incorporating a number of conventional block-like toy modules 14a of the type found in LEGO toy systems, however, the invention is not so limited. Other shapes and structures of modules may equally be used, including modules of the types found in MECCANO and K'NEX construction toys, and will now become apparent. FIGS. 13a and 13b each show respectively two adaptor modules 174,176 for use with the present invention. The lower surface of each adaptor module 174, 176 is also provided with a number of spaced cylindrical recesses (not shown) for coupling the modules 174,176 to the base 12 on the projections 30. Module 174 includes an upper ferrule or loop 178 configured for attaching MECCANO type modules thereto. Module 176 is provided with a socket-type connector 180 for use with K'NEX components. It is to be appreciated that by the use of modules 174,176 and other similar adaptor modules, the base 12 may be used with almost any type construction toy.

While FIG. 1 illustrates an assembled toy incorporating a simple rigid drive shaft element 18a and a flexible drive shaft element 18b, the multiple socket arrangement advantageously permits the construction of toys having a number of different types of movable drive shafts and modules, and in which the modules are moved in different directions and at different speeds.

While the detailed description discloses preferred embodiments of the invention, the invention is not so limited and other modifications and variations will now become apparent to persons skilled in this art. For a definition of the invention, reference may be had to the appended claims.

I claim:

1. A construction toy (10) comprising:

a plurality of releasably connectable toy modules (14);

drive shafts (18a, 18b) for actuating at least one of the toy modules into movement, said drive shafts including a first end portion (38) having a substantially polygonal cross-sectional shape, and a second end portion (36) for engaging at least one of the toy modules (14), and a supporting base (12) for supporting the toy modules thereon, said base (12) including an upper mounting surface (28) including coupling means (30) to releasably couple a plurality of said modules (14) to said base, wherein the base (12) also includes:

a plurality of openings (32) formed through the upper mounting surface (28) and each sized to permit insertion therein of the first end portion (38) of one of said drive shafts (18a, 18b);

a plurality of rotatable sockets (26), each of said sockets (26) being axially aligned with a corresponding one of said openings and having a size and shape complementary to those of the first end portions of the drive shaft to permit their insertion, and drive menas (40, 50, 66) for activating the sockets (26) in rotational movement whereby the rotation of said sockets activates any of said drive shafts (18a, 18b) inserted therein into rotational movement to rotate said toy modules engaged by said second end portion, said drive menas including a motor (66), and linkage means (40, 50) for mechanically coupling said motor to said sockets (26), wherein said motor (66) and linkage (40, 50) means are housed within the supporting base (12) as a unitary unit and at least one of the sockets (26) rotates through 360° movement and wherein the linkage means is further devised so that, on activation of the motor (66), at least one other of the sockets (26) rotates through reciprocal movement.

2. A construction toy as claimed in claim 1, wherein the linkage means includes gears (40, 50) coupled to the sockets (26), said gears being devised that, on activation of the motor (66), they rotate at least one of the sockets (26) through 360° movement.

3. A construction toy as claimed in claim 1, wherein:

the motor (66) is an electric motor;

the drive means (40, 50, 66) include power supply means (68) for supplying power to the electric motor (66); and the drive means also include clutch means (76) for decoupling the motor (66) from the sockets (26) on the application of a critical load on one of said sockets.

4. A construction toy as claimed in claim 3, wherein the toy it further comprises light emitting means (96) and a plurality of electrical receptacles (92) disposed in the upper mounting surface for electrically coupling said light emitting means (96) to the power supply means (68).

5. A construction toy as claimed in claim 3, wherein the base (12) further includes audio means for outputting an audio signal, said audio means including:

a speaker (106), and audio controller means (104, 108) for controlling the audio signal that is output.

6. A construction toy as claimed in claim 5, wherein said audio controller means comprises a removable sound card (104).

7. A construction toy as claimed in claim 1, wherein upper mounting surface (28) of the base (12) comprises at least two non-coplanar generally horizontal mounting surfaces (28a, 28b, 28c), said openings (32) and said sockets (26) being disposed in at least two of said horizontal mounting surfaces (28a, 28b, 28c).

8. A construction toy as claimed in claim 1, wherein said plurality of toy modules (14) include at least one module (34) having a bore (126) sized for rotatable insertion of one of the drive shafts (18b) therethrough.

9. A construction toy as claimed in claim 1, wherein:

the toy modules (14, 34) include recess means (22, 122) and projection means (20, 120) sized for complementary insertion into the recess means, the insertion of the projection means of one module into the recess means of another module releasably coupling the modules together, and the coupling means (30) of the base (12) is selected from said recess means and said projection means.

10. A construction toy as claimed in claim 1, wherein the coupling means (30) of the base (12) consists of a plurality of equally spaced generally cylindrical projections.

11. A supporting base (12) for use with a construction toy (10) modules (14) and drive shafts (18*a*, 18*b*) each having a first end portion (38) for engaging said base and a second end portion (36) for engaging at least one of the toy modules (14) to activate said at least one toy module into movement, the supporting base being devised for mounting the toy modules thereon and including an upper mounting surface (28) including coupling means to releasably couple a plurality of said modules (14) thereto, said supporting base comprising:

a plurality of openings (32) formed through the upper mounting surface (28), each of said openings being sized to permit insertion therein of the first end portion (38) of one of the drive shafts (18*a*, 18*b*);

a plurality of rotatable sockets (26), each of said sockets (26) being axially aligned with a corresponding one of the openings and having a size and shape complementary to those of the first end portions of the drive shafts to permit their insertion therein, and drive means (40, 50, 66) for activating the sockets (26) in rotational movement whereby the rotation of said sockets activates any of said drive shafts (18*a*, 18*b*) inserted therein into rotational movement to rotate said toy modules engaged by said second end portion, said drive means including a motor (66) and linkage means (40, 50) for mechanically connecting the motor to said sockets (26), wherein said motor (66) and linkage means (40, 50) are housed within the supporting base as a unitary unit; and at least one of the sockets (26) rotates through 360° movement and wherein the linkage means is also devised so that on activation of the motor (66) at least one other of said sockets (26) rotates through reciprocal movement.

12. A supporting base as claimed in claim 11, wherein the linkage means includes gears (40, 50) coupled to the sockets (26), said gears being devised so that, on activation of the motor (16), they rotate at least one of the sockets (26) through 360° movement.

13. A supporting base as claimed in claim 11, wherein:

the motor (66) is an electric motor connectable to a power supply means (68); and the drive means (40, 50, 66) further comprises clutch means (76) for decoupling the motor (66) from the sockets (26) on the application of a critical load on one of said sockets.

14. A supporting base as claimed in claim 13, wherein the supporting base further comprises a plurality of electrical receptacles (92) disposed in the upper mounting surface for electrically coupling light emitting means (96) to a power supply means (68).

15. A supporting base as claimed in claim 13, wherein the base (12) further includes audio means for outputting an audio signal, said audio means including:

a speaker (106), and audio controlled means (104, 108) for controlling the audio signal that is output.

16. A supporting base as claimed in claim 11, wherein the upper mounting surface (28) of the base (12) comprises at least two non-coplanar generally horizontal mounting surfaces (28*a*, 28*b*, 28*c*), said openings (32) and said sockets (26) being disposed in at least two of said horizontal mounting surfaces (28*a*, 28*b*, 28*c*).

17. A supporting base as claimed in claim 11, wherein the coupling means (30) of the base (12) consists of a plurality of equally spaced generally cylindrical projections.

18. A construction toy comprising:

a plurality of releasably connectable toy modules;

a plurality of drive shafts for actuating said toy modules into movement, each drive shaft having a first end portion having a substantially polygonal cross-sectional shape, a second end portion for engaging at least one of said toy modules, and a mid-portion for engaging at least one of said toy modules, and a mid-portion located between the first end portion and the second end portion;

a single unitary base unit for supporting said toy modules thereon, the base unit comprising:

an upper mounting surface sized to permit a plurality of said toy modules to be erected directly thereon to form a toy structure;

coupling means provided on the upper mounting surface to releasably couple said modules to said base unit;

a plurality of rotatable sockets provided at the upper mounting surface, each said socket having a complementary size and shape to the first end portion of the drive shaft to permit insertion of the first end portion into the rotatable socket, drive means for activating the sockets in rotational movement whereby the rotation of said sockets activates any of said drive shafts inserted therein into rotational movement to rotate said toy modules engaged by said second end portion, said drive means including a motor and a linkage for mechanically coupling said motor to said sockets;

wherein said motor and the linkage are housed within the unitary base unit; and wherein the linkage includes gears coupled to the sockets, said gears being arranged and sized such that on activation of the motor the linkage causes at least one of the sockets to rotate through 360° movement and at least one other of the sockets to rotate reciprocally.

19. A construction toy as claimed in claim 18, wherein:

at least one of the toy modules has a bore extending through the module, the bore have a predetermined dimension; and the mid-portion of the drive shafts have a crosssectional dimension that allows the mid-portion to rotate within the bore that extending through the said at least one module without contacting the bore.

20. A construction toy as claimed in claim 18, wherein said coupling means comprises a plurality of equally spaced generally cylindrical projections.

21. A construction toy as claimed in claim 18, wherein said base unit includes audio means housed within the base unit for outputting an audio signal, said audio means including speaker means, and means for receiving a sound card to allow selection of the sound output.

22. A construction toy as claimed in claim 18, further including light emitting means, said base unit including a power supply means and plurality of electrical receptacle means for electrically coupling with said light emitting means, said receptacle means located at the upper mounting surface.

* * * * *